US008635964B2

(12) United States Patent
Kinoshita et al.

(10) Patent No.: US 8,635,964 B2
(45) Date of Patent: Jan. 28, 2014

(54) AUTOMATED SKIP CHECKER DEVICE FOR SEWING MACHINE

(75) Inventors: Haruhiko Kinoshita, Aichi (JP); Ryuzo Sugimoto, Aichi (JP)

(73) Assignee: Kinoshita Precision Industrial Co., Ltd., Aichi (JP)

( * ) Notice: Subject to any disclaimer, the term of this patent is extended or adjusted under 35 U.S.C. 154(b) by 458 days.

(21) Appl. No.: 12/945,223

(22) Filed: Nov. 12, 2010

(65) Prior Publication Data

US 2011/0114000 A1 May 19, 2011

(30) Foreign Application Priority Data

Nov. 13, 2009 (JP) ..... 2009-260409
Aug. 5, 2010 (JP) ..... 2010-176610

(51) Int. Cl.
*D05B 69/36* (2006.01)

(52) U.S. Cl.
USPC ..... 112/273

(58) Field of Classification Search
USPC ..... 112/154, 278, 285, 293, 302, 254, 255, 112/273
See application file for complete search history.

(56) References Cited

U.S. PATENT DOCUMENTS

| | | | | |
|---|---|---|---|---|
| 3,565,027 | A * | 2/1971 | Miller et al. | 112/255 |
| 3,714,916 | A | 2/1973 | Saray | |
| 3,785,308 | A * | 1/1974 | Brandriff et al. | 112/278 |
| 4,284,020 | A | 8/1981 | Connor, Jr. et al. | |
| 4,892,048 | A * | 1/1990 | Karuga et al. | 112/254 |
| 5,199,365 | A * | 4/1993 | Arnold | 112/273 |
| 5,233,936 | A * | 8/1993 | Bellio | 112/273 |
| 5,383,417 | A * | 1/1995 | Norrid | 112/278 |
| 5,404,824 | A * | 4/1995 | Hiraoka et al. | 112/254 |
| 5,495,816 | A * | 3/1996 | Sanvito et al. | 112/165 |
| 7,536,963 | B2 * | 5/2009 | Durville et al. | 112/302 |

FOREIGN PATENT DOCUMENTS

| | | | |
|---|---|---|---|
| JP | 49-003752 | A | 1/1974 |
| JP | 50-54457 | | 5/1975 |
| JP | 50-054457 | U | 5/1975 |
| JP | 54-095352 | U | 7/1979 |
| JP | 5514091 | A | 1/1980 |
| JP | 62-155772 | U | 10/1987 |
| JP | 63-119797 | A | 5/1988 |
| JP | 8-276088 | | 10/1996 |
| JP | 08-276088 | A | 10/1996 |
| JP | 2001-062178 | A | 3/2001 |
| JP | 2006-044912 | A | 2/2006 |

OTHER PUBLICATIONS

Japanese office action in corresponding Japanese patent application 2010-176610 , Dec. 13, 2011.

* cited by examiner

*Primary Examiner* — Tejash Patel
(74) *Attorney, Agent, or Firm* — Morgan, Lewis & Bockius LLP

(57) ABSTRACT

In an automated skip checker device for sewing machine 1, a detector device 8 detects a slack portion 3*a* of a predetermined length D. The slack portion 3*a* definitely corresponds to a skip of a stitch or a disconnection of a sewing thread so as to unerringly carry out the detection with a high accuracy. The detector device 8 of the skip checker device has an air stream provider 19 which transfers a tension to an upper thread 3 as a pneumatic pressure to energize an optoelectronic switch 23 so as to make the detector device 8 structurally compact and cost-saving.

4 Claims, 6 Drawing Sheets

AUTOMATED SKIP CHECKER DEVICE FOR SEWING MACHINE

BACKGROUND OF THE INVENTION

1. Field of the Invention

The present invention relates to an automated skip checker device for sewing machine which is provided to distinguish whether or not a slack appears on a sewing thread to detect a skip of stitch or a disconnection of an upper thread in operation.

2. Description of Prior Art

In a sewing machine, an upper thread entangles with a lower thread to form consecutive stitches on a cloth material by a combination of a reciprocal movement of a sewing needle and a rotary movement of a hook (looper), as the sewing needle repetitively perforates the cloth material. The consecutive stitches formed on the cloth material are usually at regular intervals, however, the skip of stitch may arise in which one or several stitches are not formed to render a series of stitches uneven while operating the sewing machine.

One of the causes of the skip of stitch is presumably due to an uneven thickness of the cloth or an unequal twisting degree of the sewing thread.

Other causes may be an inappropriate sewing needle and an improper set gauge of the hook (looper), or an incoordinated timing between the reciprocal movement of the sewing needle and the rotary movement of the hook (looper).

When the skip of stitch arises, it becomes necessary to interrupt the sewing operation and mend the sewing machine in a way depending on the causes of the skip of stitch.

Japanese Laid-open Patent Application No. 08-276088 discloses a detector device for detecting a skip of stitch which senses a frictional noise by means of a sound sensor when a sewing thread touches and slides along a thread guide.

More specifically, the sound sensor compares the frictional noise this time to the frictional noise last time in terms of its consecutive duration per a stitch of the sewing needle, in order to calculate a displacement difference of the sewing thread based on the duration difference of the frictional noise.

On the other hand, a rotary sensor detects a revolution of the sewing machine to calculate a displacement difference of the sewing thread based on the difference between the revolution this time and the revolution last time per a stitch of the sewing needle.

The rotary sensor further compares the former displacement difference of the sewing thread with the latter displacement difference of the sewing thread.

With the result that the displacement differences of the sewing thread are compared to distinguish whether or not the skip of stitch develops, it becomes possible to unerringly detect the skip of stitch even when the sewing thread varies levels of the frictional noise unevenly per a stitch of the sewing needle.

Japanese Laid-open Patent Application No. 50-54457 discloses a method of detecting a skip of stitch and disconnection of a sewing thread in a sewing machine. The detecting method is based on the fact that a hook (looper) fails to catch an upper loop of the sewing thread when the skip of stitch appears, and develops a slack on the sewing thread, a length of which corresponds to a dimensional amount that an upper thread travels around the hook (looper).

In this instance, a strain gauge is used to confirm a tension of the upper thread portion located between a thread take-up lever and the sewing needle upon distinguishing whether or not the skip of stitch appears. More particularly, a guide ring is provided, through which the upper thread passes to transmit a sliding pressure against the guide ring by means of the strain gauge, so as to detect the skip of stitch based on a predetermined amount of the sliding pressure subjected to the strain gauge.

However, the detector device of the former Japanese Laid-open Patent Application No. 08-276088 is structurally complicated so that it may become costly. Upon comparing the displacement difference of the sewing thread based on the difference of the revolution with the respective difference based on the duration difference of the frictional noise, it may arise a situation to change the comparing requirements depending on the sewing condition. Depending on the types of the cloth material, it may arise an occasion to change the predetermined amount of the value needed to distinguish whether or not the skip of stitch appears, thus making its distinction accuracy unstable.

In the detecting method of the latter Japanese Laid-open Patent Application No. 50-54457, the sewing thread has a tendency to often change the sliding pressure against the guide ring while operating the sewing machine, so that the strain gauge may fail to correspond the predetermined amount of strain to the skip of stitch, thus making its distinction accuracy unstable in the same manner as mentioned above.

Therefore, the present invention has been made with the above drawbacks in mind, it is a main object of the invention to provide an automated skip checker device for a sewing machine which is capable of detecting a skip of stitch cost-effectively with a simplified structure, and improving an accuracy of detecting the skip of stitch and a disconnection of the sewing thread, thereby ameliorating a sewing efficiency conducive to a mass production.

SUMMARY OF THE INVENTION

According to the present invention, there is provided an automated skip checker device for a sewing machine having a sewing needle placed to form stitches on a cloth material and an engagement device provided to give a tension to a sewing thread passing through a needle hole of the sewing needle. A thread take-up lever is brought into engagement with the sewing thread to reciprocally move in association with the sewing needle. A tension provider transfers a certain amount of tension to the sewing thread on operation, so as to laterally curve the sewing thread when a slack appears on the sewing thread.

A detector device has a detection member provided to detect a position in which the slack appears, the detector device placing the detection member within a thread route from the engagement device to a tip of the sewing needle.

The skip of stitch occurs due to the fact that the hook (looper) fails to catch the upper loop of the sewing thread so as to develop a slack, a length of which corresponds to a dimensional amount that an upper thread travels around the hook (looper). The detector device detects a position in which the slack resides, which means to detect the length of the slack, thereby making it possible to detect a predetermined length of the slack which invariably corresponds to whether the skip of stitch or the disconnection of the sewing thread is present or absent, so as to unerringly detect the skip of stitch or the disconnection of the sewing thread with a high accuracy.

This makes the above detection possible with a simplified combination of the tension provider and the detector device, thus rendering the structure available cost-effectively.

According to other aspect of the present invention, the tension provider is an air stream provider which continuously gives a pneumatic pressure to the sewing thread.

The air stream provider blows off a slacked portion of the sewing thread to laterally curve the sewing thread when the skip of stitch or the disconnection appears on the sewing thread. The tension provider continuously sends the air within a thread route from the engagement device to a tip of the sewing needle, so as to play a part of a thread tension adjustment which makes the skip of stitch less likely appear on the sewing thread.

The structure is such that it makes the tension provider structurally simple and cost-effective because it is sufficient to provide the air stream as a pneumatic pressure.

According to other aspect of the present invention, the tension provider is a suction air provider which continuously transfer a vacuum pressure to the sewing thread.

Such is the structure that it makes the tension provider structurally simple and cost-effective by the same reason as mention above.

According to other aspect of the present invention, the tension provider has a torsional spring and an electrical solenoid, the latter of which protracts a plunger to elastically push one end of the torsional spring so as to continuously bring the other end of the torsional spring into an elastical engagement with the sewing thread.

Such is the structure that the torsional spring pushes a slacked portion of the sewing thread to laterally curve the slacked portion so as to detect the skip of stitch or the disconnection appeared on the sewing thread when the slack develops on the sewing thread.

This makes the tension provider structurally simple and cost-effective with a combination of the electrical solenoid and the torsional spring.

According to other aspect of the present invention, the tension provider has a torsional spring and an air cylinder, the latter of which protracts a rod to elastically push one end of the torsional spring so as to continuously bring the other end of the torsional spring into an elastical engagement with the sewing thread.

Such is the structure that the torsional spring pushes a slacked portion of the sewing thread to laterally curve so as to detect the skip of stitch or the disconnection appeared on the sewing thread when the slack develops on the sewing thread.

This makes the tension provider structurally simple and cost-effective with a combination of the air cylinder and the torsional spring.

According to other aspect of the present invention, the tension provider has a torsional spring, one end of which is elastically deformed by a predetermined amount, so that the other end of the torsional spring is continuously brought into an elastical engagement with the sewing thread.

Because one end of the torsional spring is elastically deformed by the predetermined amount to accumulate an urging force which exerts the other end of the torsional spring to make a slacked portion of the sewing thread laterally curve so as to detect the skip of stitch or the disconnection appeared on the sewing thread when the slack develops on the sewing thread.

This makes the tension provider structurally simple and cost-effective with the single torsional spring.

According to other aspect of the present invention, the tension provider has a dome-shaped holder and a spherical weight ball rotatably accommodated within the holder, and continuously engaging with the sewing thread under the influence of gravity so as to always give a tension to the sewing thread.

When the skip of stitch or the disconnection occurs on the sewing thread, a slacked portion of the sewing thread drops together with the spherical weight ball so as to curve downward.

This makes the tension provider structurally simple and cost-effective with a combination of the dome-shaped holder and the spherical weight ball, all of which are existent and accessible.

According to other aspect of the present invention, the detection member of the detector device is an optical sensor having a light emitting element and a photo element to detect the slack appeared on the sewing thread.

This makes the detector device cost-effective because the optical sensor is accessible as an existent component part.

As equivalents of the optical sensor, a proximity sensor or a contact sensor can be used, all of which are accessible as existent component parts.

BRIEF DESCRIPTION OF THE DRAWINGS

Preferred forms of the present invention is illustrated in the accompanying drawings in which.

DETAILED DESCRIPTION OF PREFERRED EMBODIMENTS

Figure 1:
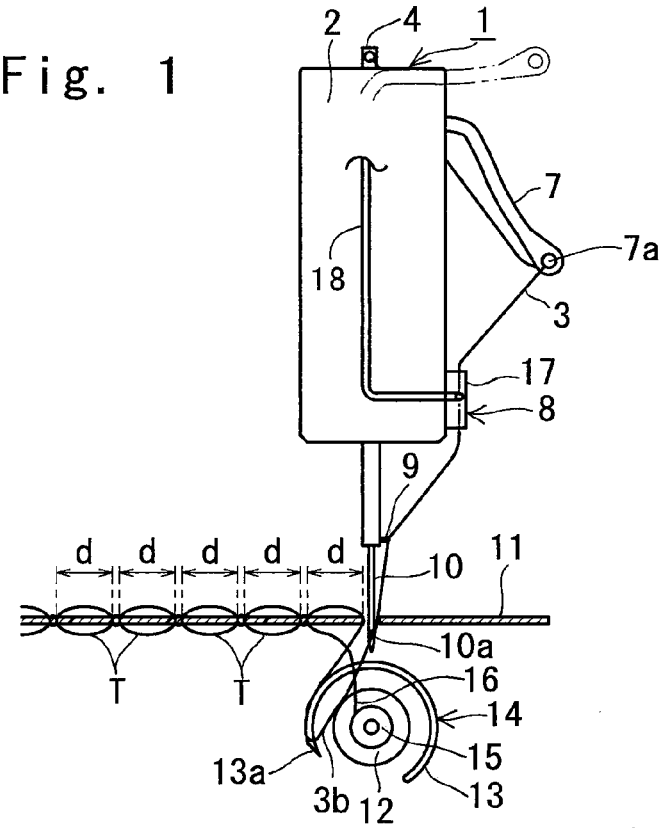
FIG. 1 is a schematic view of a sewing machine with a sewing head portion turned behind a drawing sheet by 90 degrees within a horizontal plane according to a first embodiment of the invention.

In the following description of the depicted embodiments, the same reference numerals are used for features of the same type.

Referring to FIGS. 1 through 4, a sewing machine 1 is shown according to a first embodiment of the invention. FIG. 1 depicts the sewing machine 1 with a sewing head portion 2 turned behind a drawing sheet by 90 degrees within a horizontal plane for the purpose of convenience.

Figure 2:
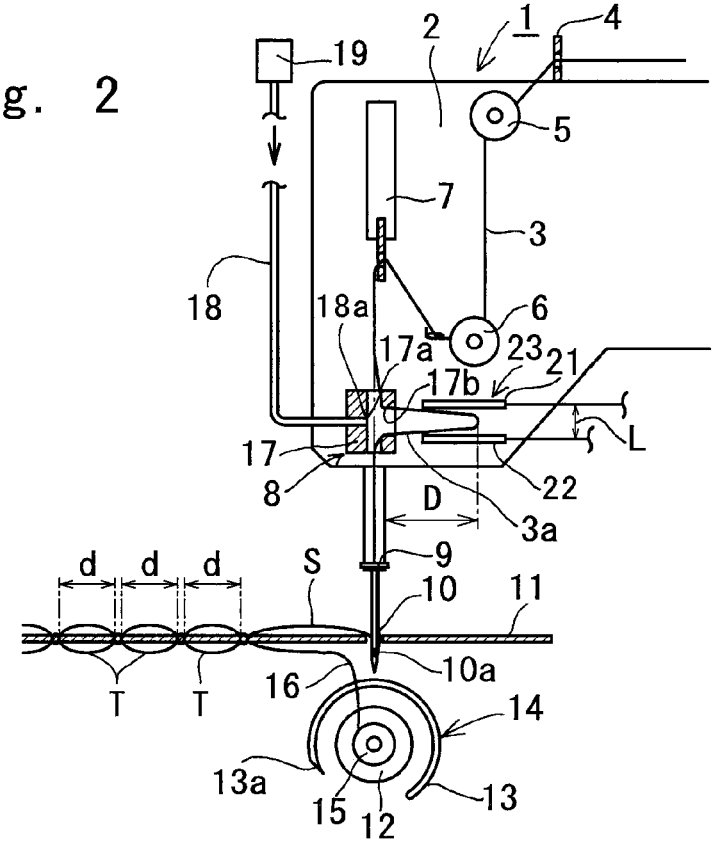
FIG. 2 is a schematic view of a sewing head portion of the sewing machine upon detecting a slack appeared on a sewing thread.

The sewing head portion 2 has a spool (not shown) which reels off an upper thread 3 to send the upper thread 3 to a detector device 8 through a ring portion 4, a first engagement device 5, a second engagement device 6 and a thread take-up lever 7 as shown in FIG. 2. The upper thread 3 is guided from the detector device 8 through a thread support portion 9 to a needle hole 10*a* of a sewing needle 10. A sewing mechanism (not shown) reciprocally moves the sewing needle 10 up-and-downward in a vertical direction, so as to form a series of stitches on a cloth material 11. The second engagement device 6 gives a tension to the upper thread 3 which is hooked by the sewing needle 10. The thread take-up lever 7 reciprocally moves with its annular portion 7*a* hooked to the upper thread 3 in association with the vertical movement of the sewing needle 10.

Under a set plate (not shown) on which the cloth material 11 is slidably placed, is a bobbin body 14 provided which has a bobbin case 12 and an exterior bobbin 13. From a bobbin 15, which is provided within the bobbin case 12, a lower thread 16 is drawn out to send the lower thread 16 to the cloth material 11 so as to form the series of stitches with the upper thread 3.

The detector device 8, which serves as an automated skip checker device, is placed within a thread route from the second engagement device 6 to a tip of the sewing needle 10 in order to provide a plastic or metallic guide plate 17 under the thread take-up lever 7.

By way of illustration, the guide plate 17 is located on a line connecting the thread take-up lever 7 to the sewing needle 10. The guide plate 17 has a vertical hole 17*a*, through which the upper thread 3 passes in the vertical direction.

At the left side of the guide plate 17, an air-blow pipe 18 is provided to be in communication with the vertical hole 17*a*. The air-blow pipe 18 is connected to an air stream provider 19 which serves as a tension provider. The air stream provider 19 is adapted to start and cease its operation respectively in association with the start and cessation of the sewing machine 1. The air stream provider 19 is sufficient with a compact size which is capable to blow an air stream as a pneumatic pressure against the upper thread 3 to transfer a certain amount of tension to the upper thread 3.

At the right side of the guide plate 17, an opening 17*b* is provided to be in a crosswise communication with the vertical hole 17*a* to face a leading end 18*a* of the air-blow pipe 18. The opening 17*b* has an inner edge beveled to form a rounded portion with the fact in mind that the upper thread 3 slides along the inner wall of the opening 17*b* as described hereinafter.

The detector device 8 has a detection member which provides an optoelectronic switch 23 (optical sensor) having a light emitting element 21 and a photo element 22. The light emitting element 21 is represented by a light emitting diode (LED), and the photo element 22 represented by a photo diode.

The light emitting element 21 and the photo element 22 space opposed by a distance L outside the opening 17*b* of the guide plate 17 in a juxtaposed relationship with the opening 17*b* of the guide plate 17.

Upon operating the sewing machine 1 as shown in FIG. 1 the sewing needle 10 entangles the upper thread 3 with the lower thread 16 so as to form the series of stitches T at regular intervals (d) with a combination of a reciprocal movement of the sewing needle 10 and a rotary movement of the bobbin body 14 as the sewing needle 10 reciprocally passes through the cloth material 11.

In so doing, the skip of stitch may appear on the sewing thread in which one or several stitches are not formed to render the series of stitches T uneven upon operating the sewing machine 1 as shown in FIG. 2.

The skip of stitch appears based on the fact that the hook 13*a* (looper) fails to catch an upper loop 3*b* of the sewing thread, and develops a slack on the sewing thread, a length of which corresponds to a dimensional amount that the upper thread 3 travels around the hook 13*a* (looper).

Concurrently with the operation of the sewing machine 1, the air stream provider 19 is energized to consecutively blow the air stream against the upper thread 3 through the air-blow pipe 18, the vertical hole 17*a* and the opening 17*b* of the guide plate 17.

Since the air stream provider 19 always gives a tension to the upper thread 3, the air stream provider 19 causes to blow off a slacked portion 3*a* of the upper thread 3 when the skip of stitch or the disconnection of the sewing thread appears on the cloth material 11. The upper thread 3 extends its slacked portion 3*a* to slide along the inner wall of the opening 17*b*, so that the slacked portion 3*a* forms an oblong curve laterally projected by a certain length D as observed at a solid line in FIG. 2.

In this instance, the upper thread 3 comes the slacked portion 3*a* to locate between the light emitting element 21 and the photo element 22 to interrupt the light emission from the light emitting element 21 in order to detect where the slacked portion 3*a* resides.

When the skip of stitch or the disconnection of the sewing thread appears on the cloth material 11, it is necessary to warn the operator of the skip S of the stitches in order to mend the sewing machine 1 in a way depending on the condition of the skip of stitch or the disconnection of the sewing thread.

Figure 3:
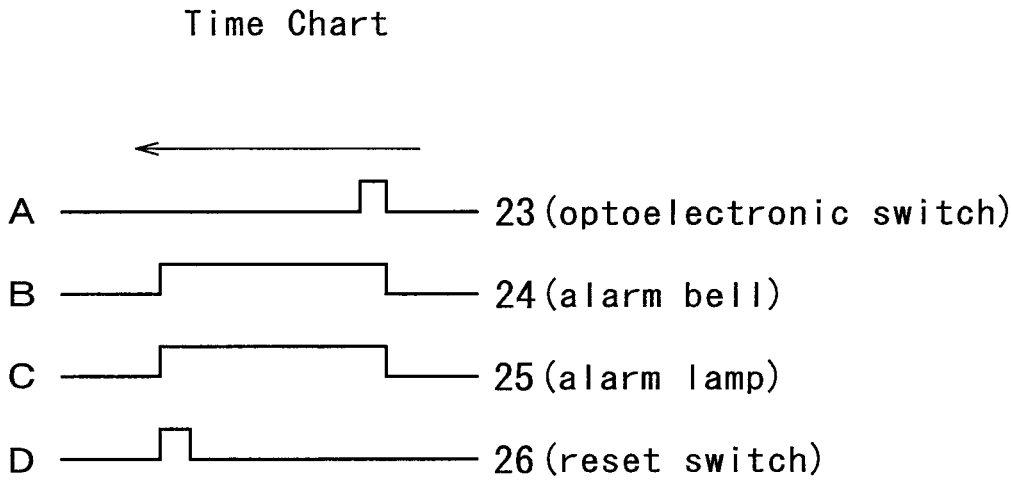
FIG. 3 is a time chart used for a detection member of a detector device.

In a warning system as shown by a time chart (A, B, C, D) in FIG. 3, the optoelectronic switch 23 is sustainedly energized to consecutively actuate an alarm bell 24 during the time in which the light emitting element 21 is interrupted at its light emission while continuously energizing an alarm lamp 25.

Figure 4:
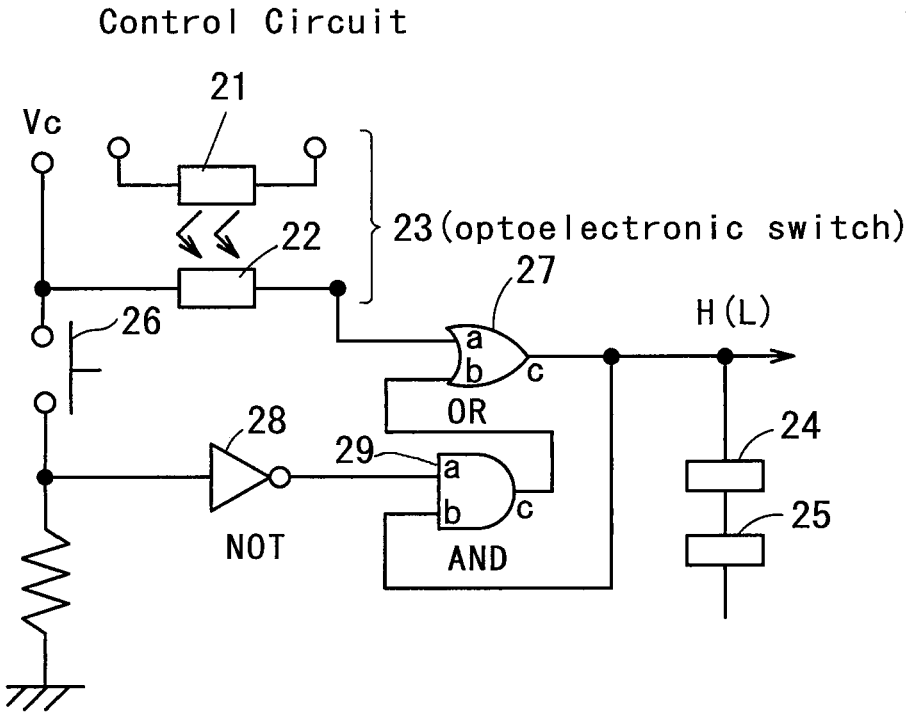
FIG. 4 is a control circuit used for the detection member of the detector device.

The warning system has a control circuit as shown in FIG. 4 in which the optoelectronic switch 23 is energized to make both an input terminal (a) and an output terminal (c) high H in an OR-circuit 27.

On the other hand, an AND-circuit 29 makes its input terminals (a), (b) high H under the presence of a NOT-circuit 28 with a button-type reset switch 26 maintained open and a voltage Vc applied across the reset switch 26. This makes an output terminal (c) of the OR-circuit 27 high H so as to consecutively energize the alarm bell 24 and the lamp 25.

After ceasing the sewing machine 1, the slacked portion 3*a* of the upper thread 3 is pulled out from between the light emitting element 21 and the photo element 22 in order to deenergize both the alarm bell 24 and the lamp 25. Then, the reset switch 26 is closed, and the AND-circuit 29 turns its input terminal (a) and output terminal (c) low L under the presence of the NOT-circuit 28 with the OR-circuit 27 turned its input terminal (b) low L.

At this time, the optoelectronic switch 23 ceases to generate its output, so that the OR-circuit 27 turns its input terminal (a) low L with its output terminal (c) turned low L so as to cease the electric current flowing through the alarm bell 24 and the lamp 25.

The control circuit may have a variety of counterparts depending on the wiring method and component parts employed herein. Instead of concurrently energizing the alarm bell 24 and the lamp 25, either the bell 24 or the lamp 25 may be energized. Alternatively, the alarm bell 24 and the lamp 25 may be intermittently energized respectively.

With the structure thus far described, the upper thread 3 develops the slacked portion 3*a* which extends by the length D when the upper thread 3 develops the skip of stitch or the disconnection which definitely corresponds to the position in which the slacked portion 3*a* is located. This makes it possible to unerringly detect the skip S of stitch or the disconnection of the upper thread 3 with a high accuracy, thereby enabling the operator to clearly distinguish whether or not the upper thread 3 develops the skip S of stitch or the disconnection.

Moreover, it is sufficient for the detector device 8 to have the air stream provider 19 and the optoelectronic switch 23, thus making the whole structure compact and cost-saving.

Figure 5:
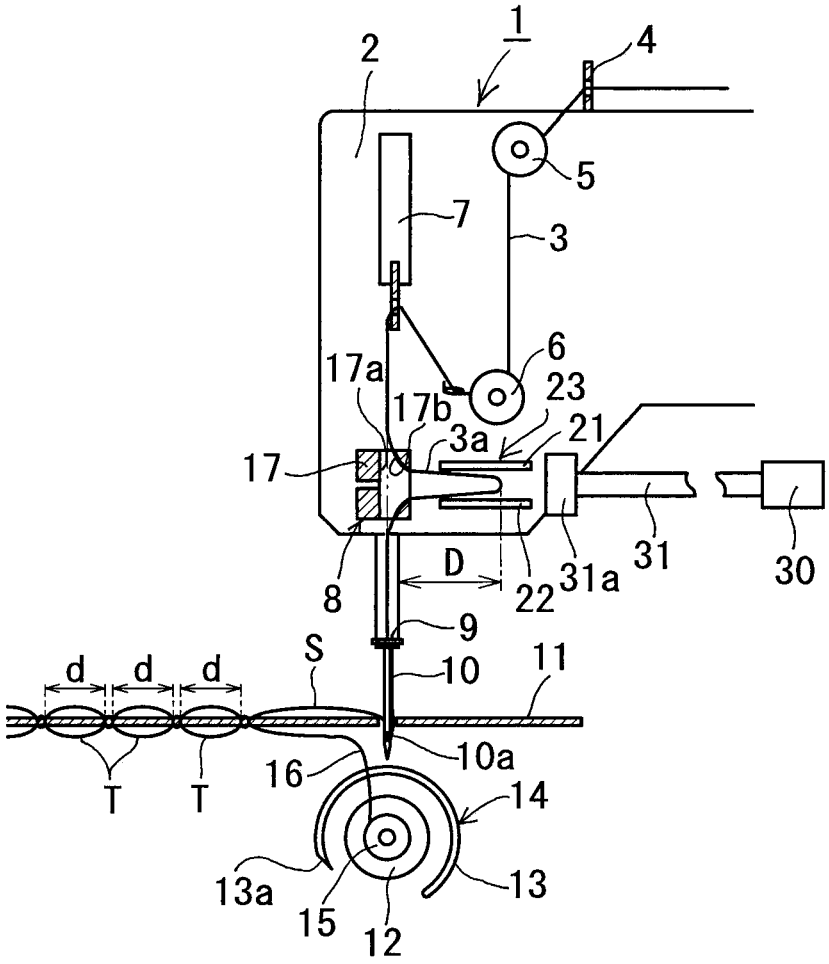
FIG. 5 is a schematic view of a sewing head portion of a sewing machine depicted with a hook (looper) and a cloth material according to a second embodiment of the invention.

FIG. 5 shows a second embodiment of the invention in which a suction air provider 30 is placed instead of the air provider 19. The suction air provider 30 extends a vacuum pipe 31, a leading end 31*a* of which is horizontally aligned with the opening 17*b* of the guide plate 17 with the optoelectronic switch 23 interposed therebetween.

Upon operating the sewing machine 1, the suction air provider 30 is energized to suction the upper thread 3 through the vertical hole 17*a* and the opening 17*b* so as to continuously give a vacuum pressure to the upper thread 3 therethrough.

When the upper thread 3 develops the skip of stitch or the disconnection, the vacuum pressure exerts on the slacked portion 3*a* through the vacuum pipe 31 and the vertical hole 17*a* to pull the slacked portion 3*a* out of the opening 7*b*, thereby curving the slacked portion 3*a* laterally so as to position between the light emitting element 21 and the photo element 22.

With the suction air provider 30 placed as the tension provider, it is possible to obtain the advantages same as secured by the first embodiment of the invention.

Further, it is sufficient for the suction air provider 30 to serve as a simple vacuum pump, thus making the whole structure compact and cost-saving as is the case with the air stream provider 19.

Figure 6:
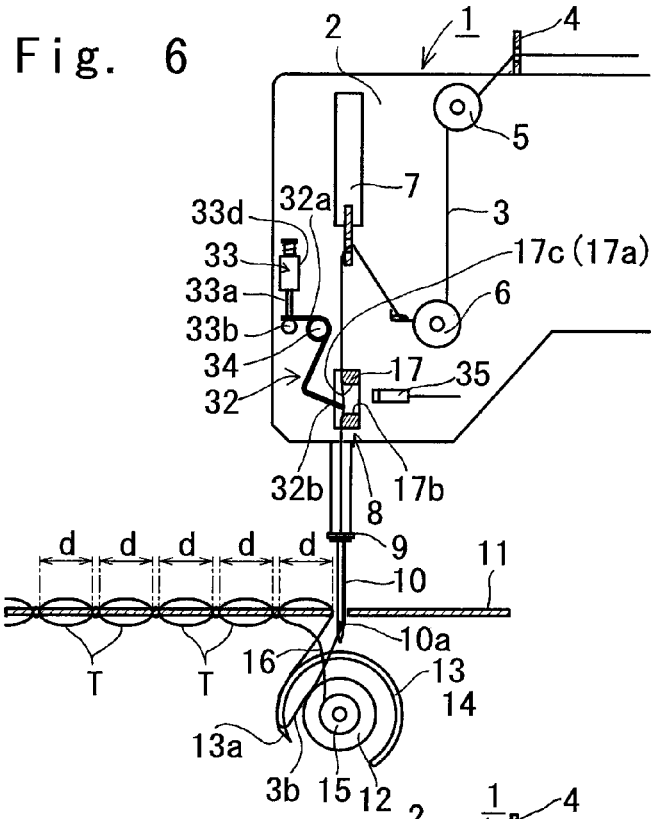
FIG. 6 is a schematic view of a sewing head portion of a sewing machine depicted with the hook (looper) and the cloth material according to a third embodiment of the invention.
Figure 7:
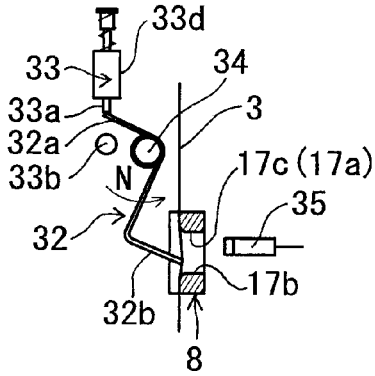
FIG. 7 is a schematic view of a detector device provided to detect a skip of stitch and disconnection of the sewing thread.
Figure 8:
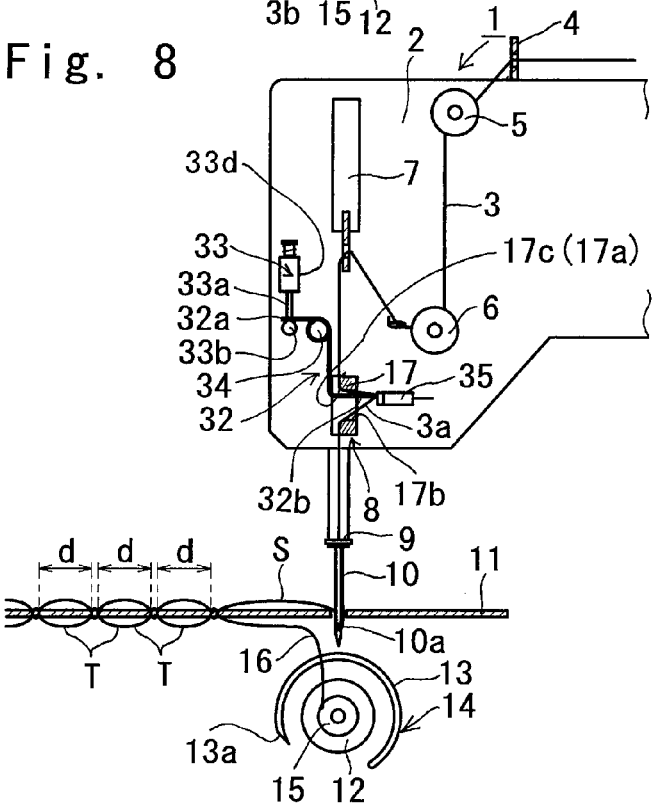
FIG. 8 is a schematic view of a sewing head portion of a sewing machine upon detecting the slack appeared on the sewing thread.

FIGS. 6-8 show a third embodiment of the invention in which a torsional spring 32 and an electrical solenoid 33 are provided instead of the air stream provider 19 as shown in FIG. 6.

In lieu of the optoelectronic switch 23, a proximity sensor 35 is provided. The electrical solenoid 33 has a cylindrical housing 33*d* in which a plunger 33*a* is retractably projected outward in an axial direction.

At the left side of the guide plate 17, an entrance hole 17*c* is provided in integral with the vertical hole 17*a* to be in communication with the opening 17*b*.

The torsional spring 32 is substantially formed into Z-shaped configuration, and supported at its upper bent-portion by an axis 34 which is provided on the sewing head portion 2 as shown in FIG. 7. One end 32*a* of the torsional spring 32 engages with a lower end of the plunger 33*a*, and the other end 32*b* of the torsional spring 32 engages with the upper thread 3 in the vicinity of the entrance hole 17*c*. The other end 32*b* is somewhat flattened at its tip to engage crosswisely with the upper thread 3.

Under the lower end of the plunger 33*a*, a stopper pin 33*b* is fixedly secured to the sewing head portion 2 just under the one end 32*a* of the torsional spring 32 in order to prevent the one end 32*a* of the torsional spring 32 from moving downward. This is because the torsional spring 32 makes the one end 32*a* engage with the stopper pin 33*b* when the electrical solenoid 33 is energized to protract the plunger 33*a* to push the one end 32*a* of the torsional spring 32 downward.

Upon operating the sewing machine 1 to concurrently energize the electrical solenoid 33, the solenoid 33 makes the plunger 33*a* protract to push the one end 32*a* of the torsional spring 32 until the one end 32*a* elastically deforms to engage with the stopper pin 33*b* as shown in FIG. 6.

Due to the elastical deformation of the one end 32*a* of the torsional spring 32, the torsional spring 32 elastically deforms the other end 32*b* around the axis 34 in the counterclockwise direction as designated by an arrow N in FIG. 7 until the other end 32*b* comes in sliding contact with the upper thread 3 to transfer a certain amount of tension to the upper thread 3 as shown in FIG. 6.

When the upper thread 3 develops the skip of stitch or the disconnection as shown in FIG. 8, the torsional spring 32 elastically exerts the other end 32*b* to make the slacked portion 3*a* laterally curve, and pushes the slacked portion 3*a* out of the entrance hole 17*c* and the opening 17*b* to encounter the proximity sensor 35 so as to detect the skip of stitch or the disconnection of the upper thread 3.

In this instance, it is sufficient for the tension provider to have the electrical solenoid 33 and the torsional spring 32 so as to make the whole structure compact and cost-saving.

Figure 9:
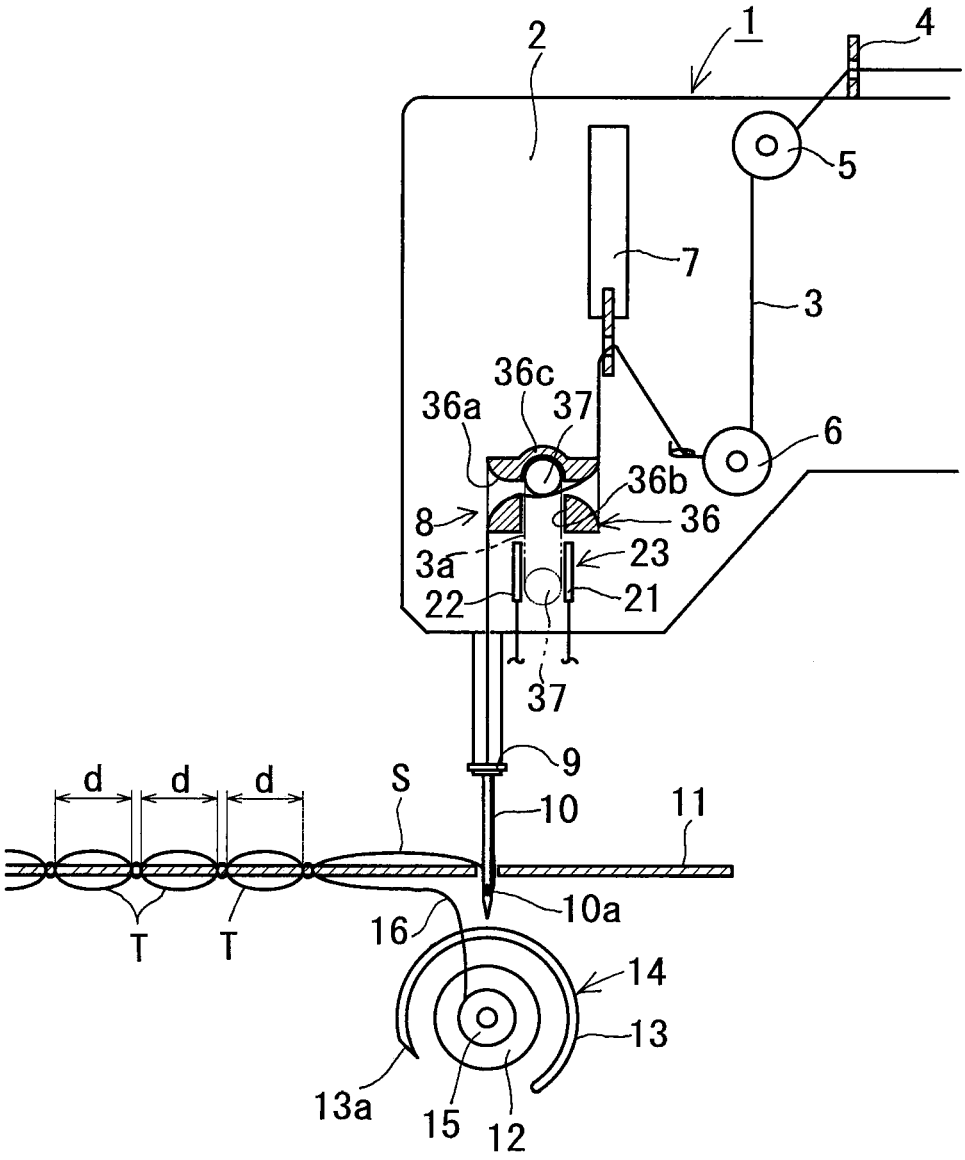
FIG. 9 is a schematic view of a sewing head portion of a sewing machine depicted with the hook (looper) and the cloth material according to a fourth embodiment of the invention.

FIG. 9 shows a fourth embodiment of the invention in which a lateral guide plate 36 is provided instead of the guide plate 17. The guide plate 36 has a lateral hole 36*a*, through which the upper thread 3 passes. At an underside of the guide plate 36, an opening 36*b* is provided in a crosswise relationship with the lateral hole 36*a*.

On an upper surface of the guide plate 36, a dome-shaped holder 36*c* is provided to be bulged upward in registration with the opening 36*b*. The holder 36*c* rotatably accommodates a spherical weight ball 37 with the weight ball 37 placed on the upper thread 3 which passes through the lateral hole 36*a*.

By way of illustration, the weight ball 37 is made of a heavier metal such as lead to transfer a certain amount of tension to the upper thread 3 within the holder 36 under the influence of gravity.

Under the guide plate 36, placed is the optoelectronic switch 23 which has the light emitting element 21 and the photo element 22.

Upon operating the sewing machine 1, the upper thread 3 moves to make the weight ball 37 roll thereon within the holder 36*c*.

When the upper thread 3 develops the skip of stitch or the disconnection, the upper thread 3 drops the weight ball 37 through the opening 36*b* together with the slacked portion 3*a* under the influence of gravity, thereby making the slacked portion 3*a* draw a curve projected downward so as to position between the light emitting element 21 and the photo element 22 as observed by the phantom line.

With the weight ball 37 and the holder 36*c* placed as the tension provider, it is possible to obtain the same advantages as secured by the first embodiment of the invention.

With the weight ball 37 and the holder 36*c* simply structured as the tension provider, it becomes possible to make the tension provider compact and cost-saving. It is to be noted that the weight ball 37 may be made of plastic or ceramic material instead of the lead metal.

Figure 10:
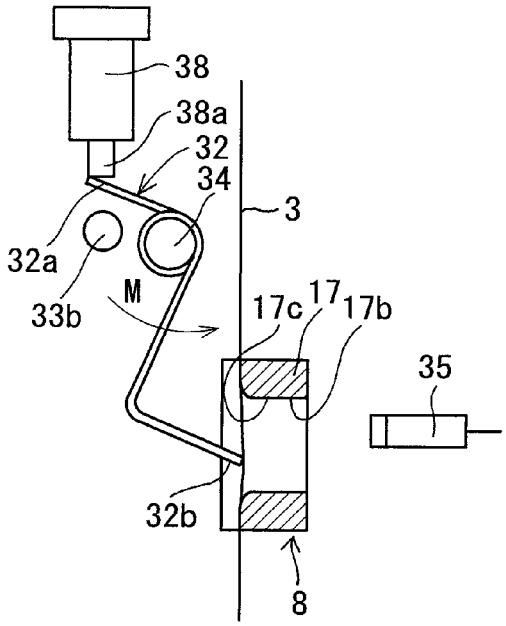
FIG. 10 is an enlarged plan view of a detector device according to a fifth embodiment of the invention.

FIG. 10 shows a fifth embodiment of the invention in which an air cylinder 38 and a rod 38*a* are provided in lieu of the electrical solenoid 33 and the plunger 33*a* of the third embodiment of the invention.

Upon operating the sewing machine 1, the air cylinder 38 is energized to protract the rod 38*a* to push and elastically deform the one end 32*a* of the torsional spring 32 so as to accumulate an elastic force within the torsional spring 32 until the one end 32*a* engages with the stopper pin 33*b*. Then, the torsional spring 32 exerts the elastic force on its other end 32*b* to elastically deform the other end 32*b* around the axis 34 in the counterclockwise direction as designated by an arrow M.

In this situation, the torsional spring 32 makes its other end 32*b* come in sliding contact with the upper thread 3 in the vicinity of the entrance hole 17*c* to transfer a certain amount of tension to the upper thread 3.

When the upper thread 3 develops the skip of stitch or the disconnection, the torsional spring 32 makes the other end 32*b* push the slacked portion 3*a* which curves laterally through the entrance hole 17*c* and the opening 17*b* to encounter the proximity sensor 35 so as to detect the skip of stitch or the disconnection of the upper thread 3.

With the air cylinder 38 and the torsional spring 32 simply structured as the tension provider, it becomes possible to make the tension provider compact and cost-saving.

Figure 11:
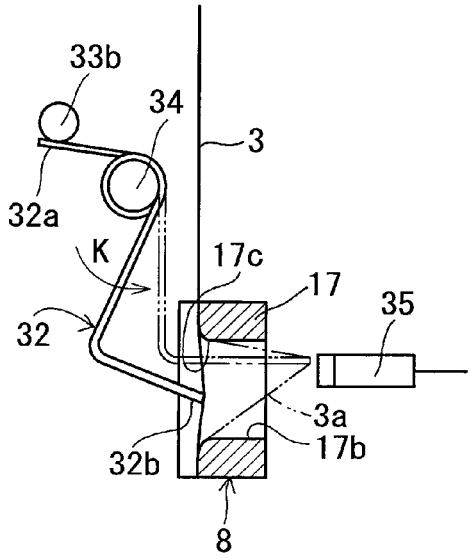
FIG. 11 is an enlarged plan view of a detector device according to a sixth embodiment of the invention.

FIG. 11 shows a sixth embodiment of the invention which omits the electrical solenoid 33 of the third embodiment of the invention.

The torsional spring 32 engages the one end 32*a* against an underside of the stopper pin 33*b* with the one end 32*a* elastically deformed, so that the other end 32*b* comes in sliding contact with the upper thread 3 in the vicinity of the entrance hole 17*c* to transfer a certain amount of tension to the upper thread 3.

Due to an elastic force accumulated as an urging force within the torsional spring 32 upon elastically deforming the one end 32*a* of the torsional spring 32, the torsional spring 32 makes the other end 32*b* pneumatically push the slacked portion 3*a* which curves laterally through the entrance hole 17*c* and the opening 17*b* to encounter the proximity sensor 35 so as to detect the skip of stitch or the disconnection of the upper thread 3 when the upper thread 3 develops the skip of stitch or the disconnection of the upper thread 3 upon operating the sewing machine 1.

With the torsional spring 32 simply structured as the tension provider, it becomes possible to make the tension provider more compact and cost-saving.

Figure 12:
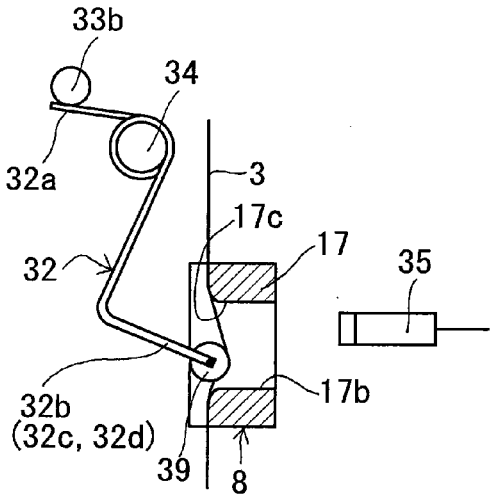
FIG. 12 is an enlarged plan view of a detector device according to a seventh embodiment of the invention.

FIG. 12 shows a seventh embodiment of the invention in which the torsional spring 32 is formed into a ribbon-shaped configuration, and a roller 39 is mounted on the other end 32*b* of the torsional spring 32 in a crosswise relationship with the upper thread 3. The other end 32*b* of the torsional spring 32 forms a frame 32*c* in which a cross piece support 32*d* rotatably supports the drum-like roller 39.

In this instance, the roller 39 comes in sliding contact with the upper thread 3 with the rotational movement accompanied. This mitigates a friction of the roller 39 against the upper thread 3 because the roller 39 smoothly slide on the upper thread 3.

As apparent from the foregoing description, the detector device makes the detection member definitely detect the position in which the slacked portion of the upper thread resides.

Since the slacked portion positionally corresponds to the skip of stitch or the disconnection of the upper thread, it becomes possible to unerringly detect the skip of stitch or the disconnection with a high accuracy when the upper thread develops the skip of stitch or the disconnection upon operating the sewing machine. This makes it possible to definitely distinguish whether or not the upper thread develops the skip of stitch or the disconnection.

The above advantage of high detection calls demands among manufacturers concerned, thus contributing to the sewing industries through the distribution of related-component parts in the market.

Modification Forms (a) It is to be noted that a leaf or clip spring may be used instead of the torsional spring 32. The torsional spring 32 may be in the form of a width-reduced and thickness-decreased ribbon. Otherwise, the torsional spring 32 may be of a funicular wire with the other end 32*b* flattened as a contact end.

(b) It is to be appreciated that instead of the sewing machine 1 (final sewing) which has a single needle with the corresponding bobbin body 14 provided under the set plate on which the cloth material 11 is slidably placed, two or multi-needle type of sewing machine may be employed. Instead of the final sewing in the sewing machine 1, employed may be a chain stitch, a multi-thread chain stitch, an over-edge chain stitch or a covering chain stitch.

(c) Instead of the optoelectronic switch 23 and the proximity sensor 35, a contact sensor, a displacement sensor, a piezoelectric/electrostrictive sensor or an oscillatory sensor may be used. At all events, any sensors will do so long as they enables users to detect the position in which the slacked portion 3*a* resides.

While several illustrative embodiments of the invention have been shown and described, variations and alternate embodiments will occur to those skilled in the art. Such variations and alternate embodiments are contemplated, and can be made without departing from the spirit and scope of the invention as defined in the appended claims.

What is claimed is:

1. An automated skip checker device for a sewing machine which has a sewing needle provided to form stitches on a cloth material, an engagement device provided to give tension to an upper thread passing through a needle hole of said sewing needle as a sewing thread, and a thread take-up lever brought into engagement with said upper thread to reciprocally move in association with said sewing needle, said automated skip checker device comprising;

a tension provider which transfers a certain amount of tension to said sewing thread in operation, so as to laterally curve said upper thread when a slacked portion appears on said upper thread, and a detector device having a detection member provided to detect a position in which said slacked portion appears, said detector device locating said detection member within a thread route from said engagement device to a tip of said sewing needle, wherein said tension provider being a suction air provider which continuously transfers a vacuum pressure to said sewing thread.

2. An automated skip checker device for sewing machine which has a sewing needle provided to form stitches on a cloth material, an engagement device provided to give a tension to an upper thread passing through a needle hole of said sewing needle as a sewing thread, and a thread take-up lever brought into engagement with said upper thread to reciprocally move in association with said sewing needle, said automated skip checker device comprising;

a tension provider which transfers a certain amount of tension to said upper thread in operation, so as to laterally curve said upper thread when a slacked portion appears on said upper thread, and a detector device having a detection member provided to detect a position in which said slacked portion appears, said detector device locating said detection member within a thread route from said engagement device to a tip of said sewing needle;

said tension provider having a guide plate located on a line connecting said thread take-up lever to said sewing needle, a vertical hole provided at a left side of said guide plate in order to pass said upper thread therethrough, and further having an air stream provider having an air-blow pipe provided to be in communication with said vertical hole, through which an air stream is blown against said upper thread to transfer a certain amount of tension to said upper thread when in operation, and an opening provided at a right side of said guide plate to be in a crosswise communication with said vertical hole to face a leading end of said air-blow pipe, said detector device having a light emitting element and a photo element which are space opposed by a distance outside the opening of said guide plate in a juxtaposed relationship with said opening of said guide plate in order to locate said slacked portion therebetween due to said air stream provider blowing off said slacked portion, so as to interrupt light emission from said photo element to said light emitting element in order to detect where said slacked portion resides when skip of said stitches or disconnection of said sewing thread appears on said cloth material.

3. An automated skip checker device for sewing machine which has a sewing needle provided to form stitches on a cloth material, an engagement device provided to give a tension to an upper thread passing through a needle hole of said sewing needle as a sewing thread, and a thread take-up lever brought into engagement with said upper thread to reciprocally move in association with said sewing needle, said automated skip checker device comprising;

a tension provider which transfers a certain amount of tension to said upper thread in operation, so as to laterally curve said upper thread when a slacked portion appears on said upper thread, and a detector device having a detection member provided to detect a position in which said slacked portion appears, said detector device locating said detection member within a thread route from said engagement device to a tip of said sewing needle;

said tension provider having a guide plate located on a line connecting said thread take-up lever to said sewing needle, a vertical hole provided at a left side of said guide plate in order to pass said upper thread therethrough, and further having a suction air provider extending a vacuum pipe, a leading end of which is horizontally aligned with an opening which is provided at a right side of said guide plate to be in a crosswise communication with said vertical hole, so that the suction air provider suctions said upper thread through said vertical hole and said opening so as to continuously give vacuum pressure to said upper thread therethrough, and said detector device having a light emitting element and a photo element which are space opposed by a distance outside the opening of said guide plate in a juxtaposed relationship with said opening of said guide plate in order to locate said slacked portion therebetween due to said vacuum pressure pulling said slacked portion out of said opening through said vacuum pipe, so as to interrupt light emission from said photo element to said light emitting element in order to detect where said slacked portion resides when skip of said stitches or disconnection of said sewing thread appears on said cloth material.

4. An automated skip checker device for sewing machine according to claim 2 or 3, wherein a warning system is provided to energize a control circuit which consecutively actuates an alarm bell during the time in which said light emitting element is interrupted at its light emission while continuously energizing an alarm lamp.

* * * * *